US007381157B2

(12) United States Patent
Blateri

(10) Patent No.: US 7,381,157 B2
(45) Date of Patent: Jun. 3, 2008

(54) EXERCISE DEVICE AND METHOD

(75) Inventor: Frank Blateri, Coppell, TX (US)

(73) Assignee: Diani, LLC, Dallas, TX (US)

( * ) Notice: Subject to any disclaimer, the term of this patent is extended or adjusted under 35 U.S.C. 154(b) by 79 days.

(21) Appl. No.: 11/301,508

(22) Filed: Dec. 13, 2005

(65) Prior Publication Data

US 2007/0135274 A1 Jun. 14, 2007

(51) Int. Cl.
*A63B 23/16* (2006.01)
*A63B 21/072* (2006.01)

(52) U.S. Cl. ..... 482/50; 482/106

(58) Field of Classification Search ..... 482/106, 482/107, 108, 93, 44–45, 49–50
See application file for complete search history.

(56) References Cited

U.S. PATENT DOCUMENTS 1,917,566 A * 7/1933 Wood ..... 482/108
4,431,185 A * 2/1984 Cisneros ..... 482/93
6,387,022 B1 * 5/2002 Smith ..... 482/106
6,773,377 B1 * 8/2004 Yu et al. ..... 482/45
7,077,786 B2 * 7/2006 Chuang et al. ..... 482/45
2005/0101440 A1 * 5/2005 Chuang et al. ..... 482/45

FOREIGN PATENT DOCUMENTS

SU 1738294 A1 * 6/1992

OTHER PUBLICATIONS

US Kettlebells, "Welcome to US Kettlebells," www.uskettlebells.com, 2 pages.

* cited by examiner

*Primary Examiner*—Fenn C. Mathew
(74) *Attorney, Agent, or Firm*—Haynes and Boone, LLP

(57) ABSTRACT

An exercise device according to which at least one weight is disposed in the enclosure and is locked in the enclosure.

13 Claims, 2 Drawing Sheets

EXERCISE DEVICE AND METHOD

BACKGROUND

This invention relates to an exercise device not unlike a kettlebell, and a method of adjusting the weight of same.

A standard kettlebell is a generally spherically-shaped cast iron weight with a handle attached. With a variety of functional motions, one can swing, pull and press a kettlebell between several positions (such as swing, rack, and lock) to achieve a wide range of fast, convenient and fluid workouts.

However, it is often desirable to change weights during a workout, depending on the particular exercise involved. This requires changing to a different kettlebell corresponding to the desired weight. Thus, an exerciser has to have several kettlebells of varying weights in order to complete one workout.

Therefore, what is needed is an exercise devise similar to a kettlebell, whose weight can be adjusted.

DETAILED DESCRIPTION

Figure 1:
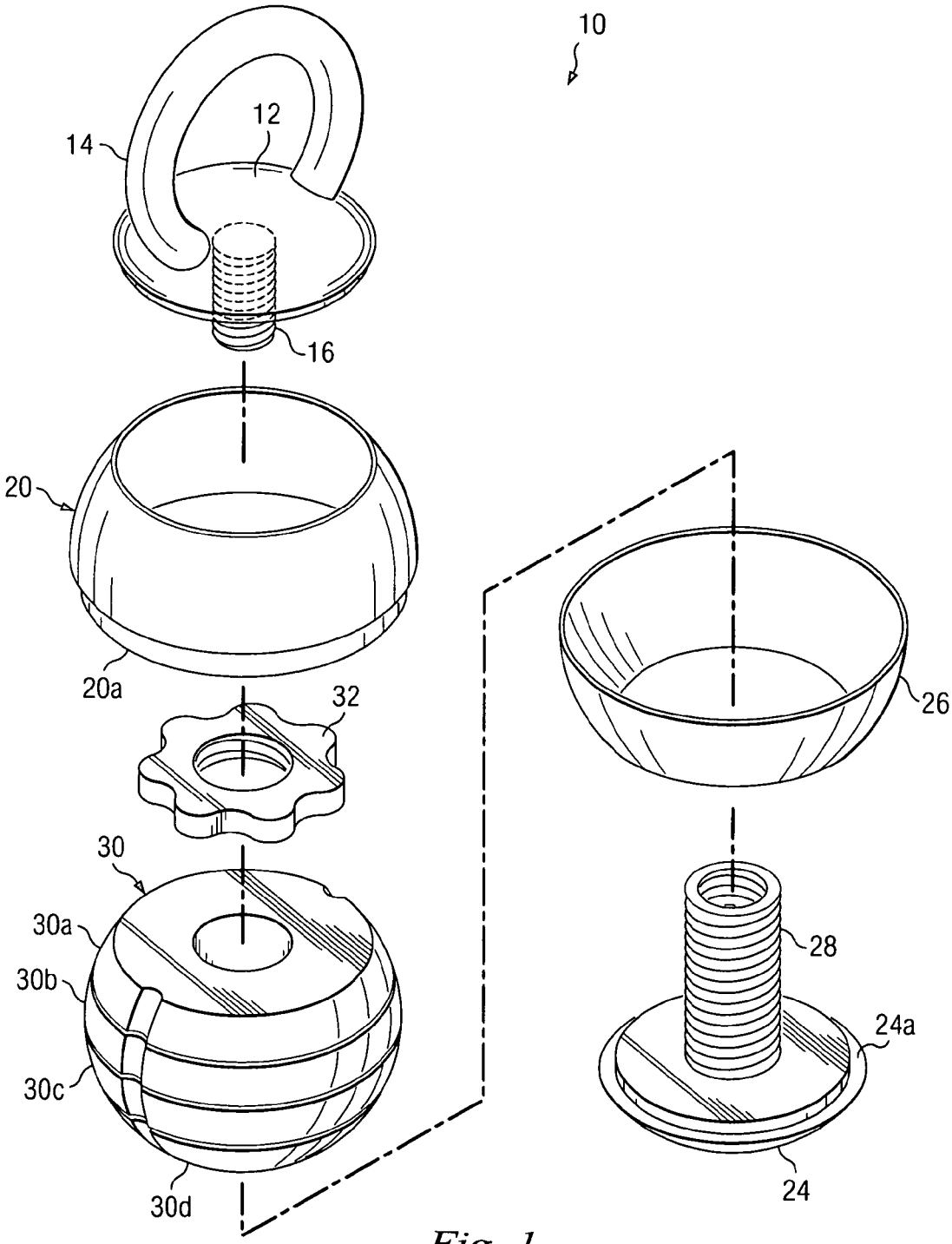
FIG. 1 is an exploded view of an exercise device according to an embodiment.

An exercise device according to an embodiment of the invention is referred to, in general, by the reference numeral 10 in FIG. 1 of the drawings. The device 10 includes a curved plate 12, a handle 14 mounted to the upper surface of the plate 12, and an externally threaded stem 16 affixed to the center of the inner surface of the plate. The plate 12, the handle 14, and the stem 16 can be formed integrally, or the handle and/or the stem can be secured to the plate in any conventional manner.

An upper, annular, curved, enclosure portion 20 has two circular open ends, one of which (the upper end as viewed in the drawing) is sized to receive the plate 12. An annular flange, or lip, 20*a* extends out from the other end of the enclosure portion 20, for reasons to be described.

A circular base 24 receives an annular, curved, lower enclosure portion 26 that has two circular, open ends, the lower one of which is supported by the base. To this end, an outer annular, radially-extending lip 24*a* is provided on the base 24 and is sized to receive the lower end of the enclosure portion 26. The other end of the enclosure portion 26 is sized to receive the lower end of the enclosure portion 20, with the lip 20*a* extending within the inner diameter of the corresponding upper portion of the enclosure portion 26 in a close fit.

An externally and internally threaded stem 28 is affixed to the center of the inner surface of the base 24, and extends through the enclosure portion 26. The stem 16 can be formed integrally with the base 24, or it can be secured to the base in any known manner.

A weight assembly 30 is provided that consists of a series of stacked annular weights 30*a*, 30*b*, 30*c* and 30*d*, each of which has a central opening slightly larger than the diameter of the stem 28 so that each weight can be placed around the stem. An internally threaded nut 32 extends over the upper weight 30*a* and threadedly engages the stem 28 to lock the weights 30*a*-30*d* in place. A central opening is provided through the nut 32 and it is understood that a lock washer, or the like, (not shown) can be provided, as needed to secure the nut in its locking position. The outer surfaces of the weights 30*a*-30*d* are slightly spaced from, and configured to generally conform to, the corresponding inner surfaces of the enclosure portions 20 and 26. An internally threaded bore extends through the stem 28 and is sized to receive the stem 16 in a threaded engagement.

Figure 2:
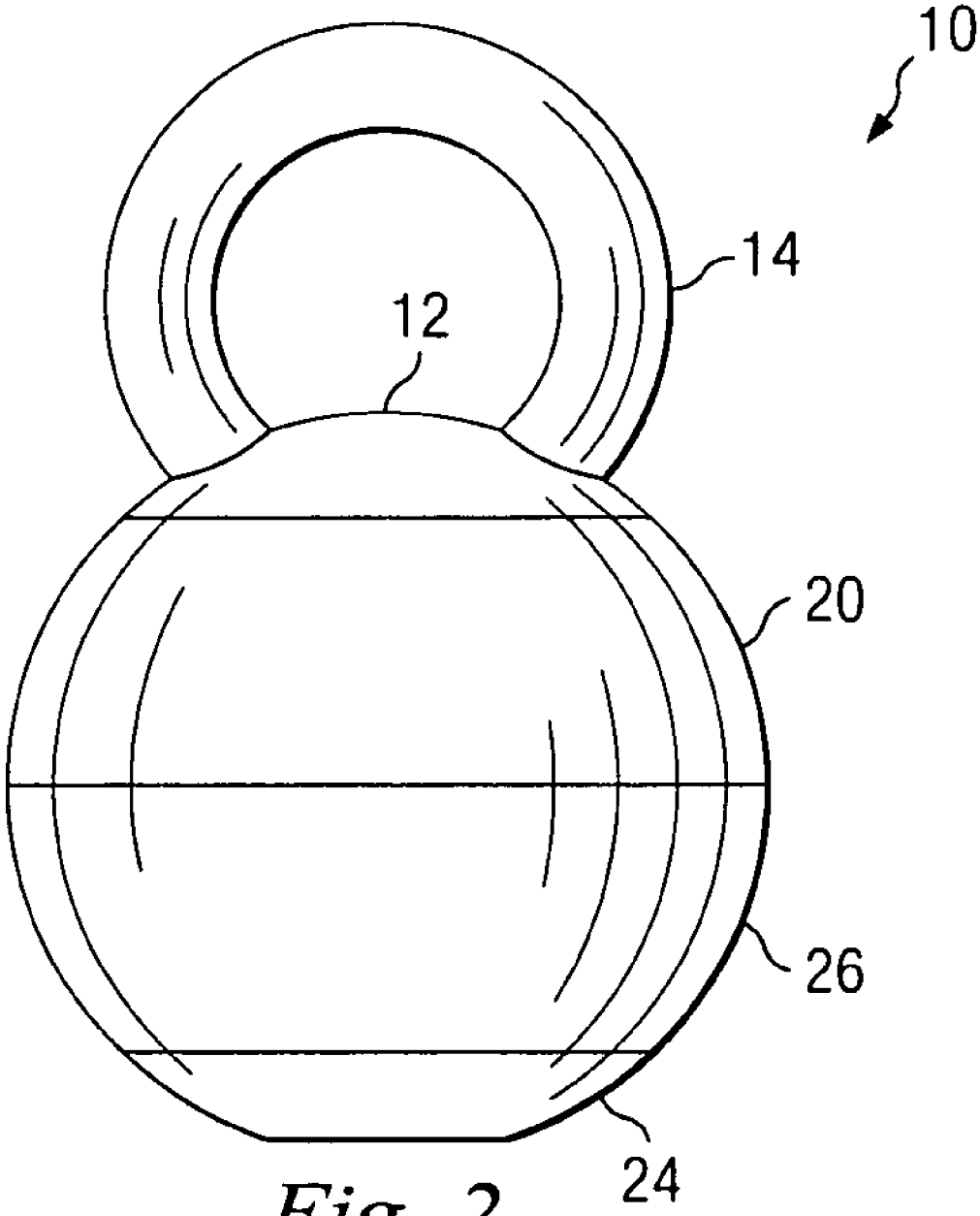
FIG. 2 is an elevational view of the assembled device of FIG. 1.

To assemble the device 10, the lower enclosure portion 26 is placed over the base 24 with the stem extending through the enclosure portion. The weight assembly 30 is lowered into the enclosure portion 26 so that the stem 28 extends through the openings in the weights 30*a*-30*d*. The nut 32 is then threadedly engaged with the upper end portion of the stem 28 to lock the weights 30*a*-30*d* in place. The upper enclosure portion 20 is then lowered over the weight assembly 30 until the lip 20*a* extends within the inner diameter of the corresponding upper portion of the lower enclosure portion 26 in a close fit. The plate 12 is then lowered over the enclosure portion 20 until the stem 16 threadedly engages the stem 28. The plate 12, and therefore the stem 16, are rotated to tighten the plate, and therefore the upper enclosure portion 20, relative to the lower enclosure portion 26 to enclose the weight assembly in the enclosure formed by the plate 12, the base 24, and the enclosure portions 20 and 26, as shown in FIG. 2.

Of course, the number of weights 30*a*-30*d* in the weight assembly 30 can be varied as necessary to change the overall weight of the device 10. Also, one or more of the weights 30*a*-30*d* can be replaced by another weight of a different weight. In each case, the plate 12, and therefore the stem 16, are rotated until the engagement of the stem 16 with the stem 28 is released. The enclosure portion 20 and the nut 32 are removed and one or more of the weights 30*a*-30*d* are removed or replaced as needed, depending on the particular exercise. Then the above-described assembly procedure is repeated to lock the weights 30*a*-30*d* in place, and to lock the enclosure portions 20 and 26 between the plate 12 and the base 24.

Therefore, when using the device 10, one can change weights during a workout, depending on the particular desired exercise, without having to resort to use of another separate device.

VARIATIONS

It is understood that variations can be made in the foregoing without departing from the scope of the invention. For example, the enclosure portion 26 can be placed on the base 24 after the weights 30*a*-30*d* are tightened over the base 24, as described above. Also, the number of weights in the assembly 30 can be varied, and each weight 30*a*-30*d* of the assembly can be different from, or the same as, the other weights in the assembly.

It is understood that spatial references, such as "upper", "lower", "radial", "outer", "over", "between", "inner", and "surrounding" are for the purpose of illustration only and do not limit the specific orientation or location of the layers described above.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. An exercise device comprising:

a first annular enclosure portion defining a first curved inner surface;

a second annular enclosure portion removably engaged with the first enclosure portion, the second enclosure portion defining a second curved inner surface;

a first stem at least partially extending within the first enclosure portion;

at least one annular weight defining an outer surface and comprising a central opening through which the first stem extends;

a second stem at least partially extending within the second enclosure portion, the second stem threadably engaging the first stem to thereby enclose the at least one annular weight in an enclosure formed by at least the first and second enclosure portions;

a nut disposed within the enclosure and threadably engaged with the first stem to lock the at least one annular weight in place;

a base removably engaged with the first enclosure portion, wherein the first stem extends from the base;

a plate removably engaged with the second enclosure portion, the plate defining inner and outer surfaces, wherein the second stem extends from the inner surface of the plate; and a handle extending from the outer surface of the plate;

wherein the enclosure is formed by at least the plate, the base and the first and second enclosure portions.

2. The device of claim 1 wherein the enclosure defines an inner cavity having a substantially spherical shape in which the at least one annular weight and the first and second stems extend; and wherein the outer surface of the at least one annular weight generally conforms to at least a portion of the substantially spherical shape of the inner cavity defined by the enclosure.

3. The device of claim 2 further comprising:

at least one other annular weight defining an outer surface and comprising a central opening through which the first stem extends;

wherein the outer surface of the at least one other annular weight generally conforms to at least another portion of the substantially spherical shape of the inner cavity defined by the enclosure.

4. The device of claim 3 wherein the respective outer surfaces of the annular weights are generally arcuately aligned and generally contiguous; and wherein the portions of the substantially spherical shape to which the outer surfaces of the annular weights generally conform, respectively, are generally arcuately aligned and generally contiguous.

5. An exercise device comprising:

a first annular enclosure portion defining a first curved inner surface;

a second annular enclosure portion removably engaged with the first enclosure portion, the second enclosure portion defining a second curved inner surface;

a first stem at least partially extending within the first enclosure portion;

at least one annular weight defining an outer surface and comprising a central opening through which the first stem extends;

a second stem at least partially extending within the second enclosure portion, the second stem threadably engaging the first stem to thereby enclose the at least one annular weight in an enclosure formed by at least the first and second enclosure portions;

a base removably engaged with the first enclosure portion, wherein the first stem extends from the base; and a plate removably engaged with the second enclosure portion, the plate defining inner and outer surfaces;

wherein the second stem extends from the inner surface of the plate; and wherein the enclosure is formed by at least the plate, the base and the first and second enclosure portions.

6. The device of claim 5 further comprising:

a handle extending from the outer surface of the plate.

7. An exercise device comprising:

a first annular enclosure portion defining a first curved inner surface second annular enclosure portion removably engaged with the first enclosure portion, the second enclosure portion defining a second curved inner surface;

a base removably engaged with the first enclosure portion;

a first stem extending from the base and at least partially extending within the first enclosure portion;

a plate removably engaged with the second enclosure portion, the plate defining inner and outer surfaces;

a handle extending from the outer surface of the plate;

first and second annular weights, each of the first and second annular weights defining an outer surface and comprising a central opening through which the first stem extends;

a second stem extending from the plate and at least partially extending within the second enclosure portion, the second stem threadably engaging the first stem to thereby enclose the first and second annular weights in an enclosure formed by at least the base, the plate and the first and second enclosure portions; and a nut disposed within the enclosure and threadably engaged with the first stem to lock the first and second annular weights in place;

wherein the enclosure defines an inner cavity having a substantially spherical shape in which the first and second annular weights and the first and second stems extend;

wherein the outer surfaces of the first and second annular weights generally conform to first and second portions, respectively, of the substantially spherical shape of the inner cavity defined by the enclosure;

wherein the respective outer surfaces of the annular weights are generally arcuately aligned and generally contiguous; and wherein the first and second portions of the substantially spherical shape to which the outer surfaces of the annular weights generally conform, respectively, are generally arcuately aligned and generally contiguous.

8. A method comprising:

providing a first annular enclosure portion defining a first curved inner surface;

removably engaging a second annular enclosure portion with the first enclosure portion, the second enclosure portion defining a second curved inner surface;

at least partially extending a first stem within the first enclosure portion;

providing at least one annular weight defining an outer surface and comprising a central opening;

extending the first stem through the central opening of the at least one annular weight;

at least partially extending a second stem within the second enclosure portion;

threadably engaging the second stem with the first stem to thereby enclose the at least one annular weight in an enclosure formed by at least the first and second enclosure portions;

threadably engaging a nut disposed within the enclosure with the first stem to lock the at least one annular weight in place;

removably engaging a base with the first enclosure portion, wherein the first stem extends from the base;

removably engaging a plate with the second enclosure portion, the plate defining inner and outer surfaces, wherein the second stem extends from the inner surface of the plate; and extending a handle from the outer surface of the plate;

wherein the enclosure is formed by at least the plate, the base and the first and second enclosure portions.

9. The method of claim 8 wherein the enclosure defines an inner cavity having a substantially spherical shape in which the at least one annular weight and the first and second stems extend; and wherein the outer surface of the at least one annular weight generally conforms to at least a portion of the substantially spherical shape of the inner cavity defined by the enclosure.

10. The method of claim 9 further comprising:

providing at least one other annular weight defining an outer surface and comprising a central opening;

extending the first stem through the central opening of the at least one other annular weight;

wherein the outer surface of the at least one other annular weight generally conforms to at least another portion of the substantially spherical shape of the inner cavity defined by the enclosure.

11. The method of claim 10 wherein the respective outer surfaces of the annular weights are generally arcuately aligned and generally contiguous; and wherein the portions of the substantially spherical shape to which the outer surfaces of the annular weights generally conform, respectively, are generally arcuately aligned and generally contiguous.

12. A method comprising:

providing a first annular enclosure portion defining a first curved inner surface;

removably engaging a second annular enclosure portion with the first enclosure portion, the second enclosure portion defining a second curved inner surface;

at least partially extending a first stem within the first enclosure portion;

providing at least one annular weight defining an outer surface and comprising a central opening;

extending the first stem through the central opening of the at least one annular weight;

at least partially extending a second stem within the second enclosure portion;

threadably engaging the second stem with the first stem to thereby enclose the at least one annular weight in an enclosure formed by at least the first and second enclosure portions;

removably engaging a base with the first enclosure portion, wherein the first stem extends from the base; and removably engaging a plate with the second enclosure portion, the plate defining inner and outer surfaces;

wherein the second stem extends from the inner surface of the plate; and wherein the enclosure is formed by at least the plate, the base and the first and second enclosure portions.

13. The method of claim 12 further comprising:

extending a handle from the outer surface of the plate.

* * * * *